United States Patent [19]

MacDuffee

[11] Patent Number: 4,638,967

[45] Date of Patent: Jan. 27, 1987

[54] COLLAPSIBLE SUPPORT FRAME WITH RECEPTACLE

[76] Inventor: Richard J. MacDuffee, R.R. #1, Palgrave, Ontario, Canada

[21] Appl. No.: 726,401

[22] Filed: Apr. 23, 1985

[51] Int. Cl.[4] ..... A63B 55/04

[52] U.S. Cl. ..... 248/97; D34/6

[58] Field of Search ..... 248/95, 96, 97, 98, 248/99, 100, 101; D34/6; 232/43.1, 43.2, 43.5; 119/1; 5/99 B, 94, 112, 114

[56] References Cited

U.S. PATENT DOCUMENTS

| | | | |
|---|---|---|---|
| 2,809,383 | 10/1957 | Fenner et al. | 5/114 X |
| 3,115,364 | 12/1963 | Berlin | 5/94 X |
| 3,227,137 | 1/1966 | Goldman et al. | 119/1 |
| 3,240,457 | 3/1966 | Backlund et al. | 248/99 |
| 3,349,413 | 10/1967 | Merelis | 5/94 |
| 3,358,647 | 12/1967 | Wilsom | 119/1 |
| 3,416,495 | 12/1968 | Wilsom | 119/1 |
| 3,735,430 | 5/1973 | Platz | 5/94 X |
| 4,312,295 | 1/1982 | Harrington | 119/1 |
| 4,538,309 | 9/1985 | Gunter | 5/99 B |

*Primary Examiner*—Ramon O. Ramirez

*Attorney, Agent, or Firm*—Weldon F. Green

[57] ABSTRACT

A collapsible support frame for a receptacle comprising a frame of generally rectilinear configuration including opposed spaced apart front and rear frame portions connected together with opposed spaced apart side frame portions such that the side frame portions in the regions of the opposed front and rear frame portions respectively present downwardly projecting surface engaging formations of like extent, the disposable receptacle including opposed front and rear panels and opposed side panels terminating lowermost in a bottom panel and having a perimetral extent so as to be disposable within the collapsible support frame, the opposed front and rear panels and opposed side panels having a vertical extent exceeding that of the downwardly projecting surface engaging formations of the collapsible support frame and having a perimetral extent so that when the opposed front and rear panels and opposed side panels are folded over the opposed spaced apart front and rear frame portions and opposed spaced apart side frame portions respectively of the collapsible support frame such frame is constrained in an erect stable configuration.

14 Claims, 6 Drawing Figures

COLLAPSIBLE SUPPORT FRAME WITH RECEPTACLE

FIELD OF THE INVENTION

This invention relates to improvements in a collapsible support frame for a receptacle, and more particularly to the manner in which the receptacle and collapsible support frame cooperate so as to provide, when fully erect and in use, increased structural strength and stability as compared with known alternatives.

More particularly this invention relates to improvements in the collapsible support frame such that the receptacle when disposed within the erected support frame constrains same in an erect stable configuration so that when the receptacle disengages the support frame such frame can be reduced to a compact state to facilitate the ease of transportation.

BACKGROUND OF THE INVENTION

Collapsible support frames for receptacles falling within this category comprise a frame of generally rectilinear configuration including front, rear and side portions, the front, rear and side portions consisting of means to support the frame structure so as to present the disposable receptacle opening upwardly when same engages the support frame.

One example of an early support frame for a receptacle is that found in U.S. Pat. No. 3,227,137 wherein a liner for a sanitary container or commode is disclosed such that the liner is fabricated from polyethylene and is shaped so as to be easily fitted into a container of upright square or rectangular configuration.

The liner is fabricated from a long tubular section of thermoplastic material folded inwardly at opposite sides for approximately one-third of the total diameter of the tube to present folds on either sides.

After the folds have been made the tubular arrangement is compressed and a heat seam is made substantially along the bottom edge thereof.

As the front and rear walls are moved apart exposing the heat sealed seam triangular configurations are produced which result in further folds directed towards the bottom of the liner acting as reinforcements.

The sides of the liner extend vertically so as to extend beyond the side walls of the container and are folded thereover. The walls of the commode give support to the liner.

Another prior alternative is the pet commode disclosed in U.S. Pat. No. 3,358,647 which is particularly directed towards a foldable and disposable receptacle.

The tray like receptacle comprises a tubular frame with a removable cover for placement with the frame upon the floor or other flat supporting surface. Further, an envelope or bag like cover of polyethalene is selected to be of a size so as to loosely enclose the frame. When such bag-like cover is fitted with the frame the upper layer will be supported and lie flat on the lower layer to form a double thickness dish-like container having a depth of the order of the diameter of the component rods of the frame.

Still another embodiment of a support frame for a receptacle demonstrating the trend of development in this field is that disclosed by U.S. Pat. No. 3,416,495 in which a litter box or commode is defined by upstanding walls of rectilinear configuration in plan from which extends an integral flexible sheet. Such commode or container is adapted to receive a paper liner which corners extend over the corners of the frame and are held down by elastic bands anchored over upwardly projecting knobs formed integrally with the framework at the corners thereof.

This patent reveals the use of extensible anchoring elements, preferabley elastic bands, for securing a liner to the supporting frame.

Finally, another prior alternative is revealed by Canadian Pat. No. 923,093 in which a collapsible unit is defined by a substantially rectangular frame and a bag of flexible material which has a bottom panel, two pairs of opposed side panels and an open upper face of substantially the same size and shape as the rectangular frame.

Located at the side panels are at least two extending members having substantially the same size and shape which swing outwardly to establish the tautness of the bag together with a board which is stiff when disposed between the extending members urging them against adjacent side panels.

OBJECTS OF THE INVENTION

The principal object of this invention is to provide a light weight collapsible support frame of the aforementioned type that includes an even more simplified frame work of cooperating components and elements as compared with the prior known structures identified herein or other alternatives, yet imparts increased structural strength and stability when fully erect and in use.

More particularly, it is a very important object of this invention to limit the number of required components to a minimum, to adopt the least complicated appropriate shaping for each without diminishing the strength of that component, utilizing stock items of requisite tensile and shear strength and limiting the number of connections to a minimum sufficient to preserve the integrity of the frame work, all of which promotes greater efficiency and keeps the cost of production down.

It is also an important object to provide a collapsible support frame structure whose principal load supporting members can be made or fashioned from metal rods having standard dimensions in cross-section.

Still another very important object is to provide a collapsible support frame for a receptacle of the type and character indicated which will meet contemporary standards of sanitation and styling.

FEATURES OF THE INVENTION

According to the invention, a collapsible support frame for a receptacle is provided wherein the frame is of generally rectilinear configuration including opposed spaced apart front and rear frame portions and opposed spaced apart side frame portions. The side frame portions in the regions of the opposed spaced apart front and rear frame portions respectively present downwardly projecting surface engaging formations of like extent. A disposable receptacle of generally rectilinear outline includes opposed front and rear panels and opposed side panels terminating lowermost in a bottom panel. The receptacle opens upwardly and has a perimetral extent throughtout its front, rear and side panels being substantially equal to the perimetral extent throughout the front, rear and side frame portions of the support frame so that the receptacle is disposable within the support frame.

The opposed front and rear panels and opposed side panels have a vertical dimension exceeding that of the downwardly projecting surface engaging formations such that when the opposed front and rear panels and opposed side panels are folded over the front and rear frame portions and side frame portions respectively of the collapsible support frame such frame is constrained in an erect stable configuration.

More particularly, one of the features of this invention resides in providing a collapsible support frame for a receptacle of the type aforementioned in which the front and rear frame portions and side frame portions of the collapsible support frame are constrained against separation in an interengaging relation maintaining the collapsible support frame in an erect stable configuration by the opposed front and rear panels and opposed side panels of the receptacle when same is folded thereover.

Still, more particularly, it is a feature of this invention to provide a collapsible support frame for a receptacle of the type aforementioned wherein said opposed spaced apart front and rear frame portions are comprised of cylindrical tubes having substantially constant inner and outer surfaces extending throughout the axial extent of same and the opposed spaced apart side frame portions are comprised of cylindrical rod-like formations having a substantially constant outer surface extending throughout the axial extent of same.

It is another feature of the invention to provide a collapsible support frame for a receptacle of the type aforementioned wherein the spaced apart opposed side frame portions have the cylindrical rod-like formations presenting in their respective end regions right angle turns positioning the ends such that they extend an equal distance from the side frame portions perpendicular to the downwardly projecting surface engaging formations.

Still another feature resides in having the ends of the cylindrical rod-like formations of the side frame portions being presented within the ends of the cylindrical tubes of the front and rear frame portions such that the substantially constant inner surface of the cylindrical tubes engages the substantially constant outer surface of the cylindrical rod-like formations such that the opposed front and rear panels and opposed side panels of the receptacle constrain said cylindrical tubes and said rod-like formations in an interengaging relation against separtion maintaining the collapsible support frame in an erect stable configuration.

It would be appreciated that additional support to the collapsible support frame for a receptacle can be provided by a clamping means which secures the receptacle to the support frame when the front and rear panels and side panels of the receptacle are folded over the opposed spaced apart front and rear frame portions and side frame portions respectively of the collapsible support frame.

Further, according to the invention in the preferred embodiment at least two planes of the symmetry extend throughout the collapsible support frame for a receptacle, one being a vertical plane of symmetry extending from front to rear, the other being a vertical plane of symmetry extending from side-to-side.

Still more particularly, by establishing through the dimensioning of the vertical extent of the downwardly depending surface engaging projection formations a collapsible support frame for a receptacle can be achieved which, depending upon this dimensioning, has a wide range of applications for receiving a variety of wastes or other suitable material, maintaining certain standards of sanitation while, at the same time, providing a certain aesthetic appeal to the overall structure.

These and other objects and features will become apparent upon reading the following description together with the illustrations of a collapsible support frame for a receptacle embodying the invention appearing in the accompanying drawings.

THE DRAWINGS

THE PREFERRED EMBODIMENTS OF THE INVENTION

Figure 1:
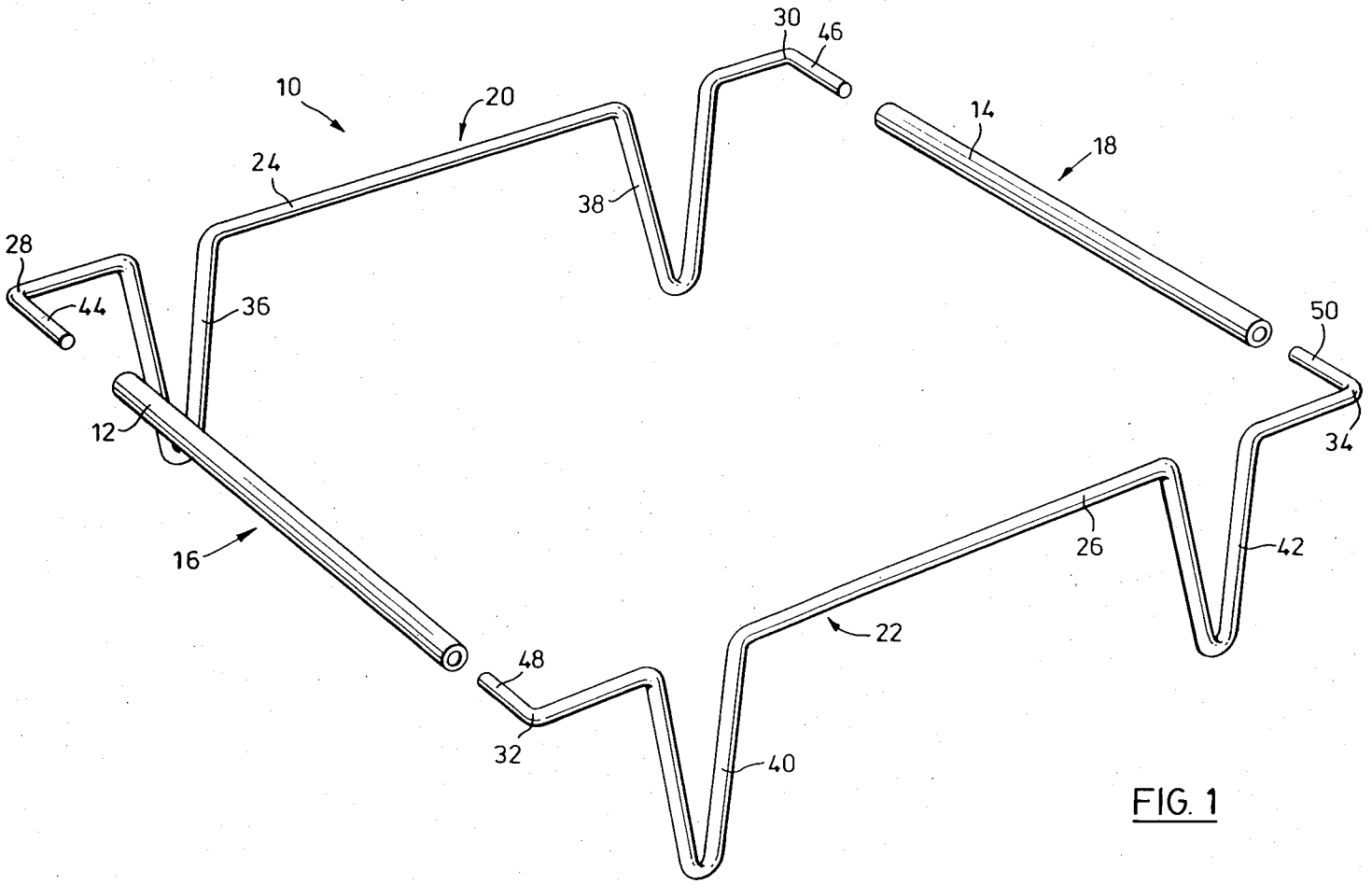
FIG. 1 is an exploded view of the preferred embodiment of a collapsible support frame made in accordance with the invention taken from a point to the right and upwardly of the front portion thereof.

The collapsible support frame for a receptacle illustrated by the several drawings includes a frame indicated generally at 10 including opposed spaced apart like tubes 12, 14, preferably composed of plastic, defining front and rear frame portions 16 and 18 respectively.

Side frame portions 20, 22 of collapsible support frame 10 are comprised of opposed spaced apart metal rods 24, 26 of cylindrical configuration having a substantially constant cross-section throughout the longitudinal extent of same.

Metal rods 24, 26 terminate near their respective end regions in right angle turns 28, 30 and 32, 34, respectively, so as to define, in combination with tube portions 12, 14 a support frame having a substantially rectilinear outline.

Further, metal rods 24, 26 have an axis extending longitudinally thereof about which a symmetrical outer surface is defined by a substantially constant radius. In the preferred embodiment illustrated in FIG. 1 rods are of size 4 gauge (0.232").

Near the regions of the front and rear frame portions 16, 18 metal rods 24, 26 of side frame portions 20, 22 respectively present downwardly depending surface engaging projection formations 36, 38, and 40, 42 respectively for supporting frame 10 upon a suitable surface.

Projection formations 36, 38, and 40, 42 preferably are of matching configuration and extent so as to depend downwardly an equal distance imparting stability to the erected support frame 10 when same is placed upon a suitable surface during use.

Projection formations 36, 38 of metal rod 24 near the regions of the front and rear frame portions 16, 18 respectively are longitudinally separated by a distance being substantially equal to the longitudinal distance separating projection formations 40, 42 along metal rod 26. Such matching longitudinal spacings between projection formations 36, 38 and between projection formations 40, 42 along metal rods 24 and 26 respectively provides additional stability to support frame 10 when same is assembled and in use by evenly distributing the weight of support frame 10 over the supporting surface.

Right angle turns 28, 30 position the ends 44, 46 of metal rod 24 such that they extend an equal distance from the side frame portion 20 perpendicular to the downwardly depending projection formations 36, 38.

Similarly, right angle turns 32, 34 position ends 48, 50 of metal rod 26 such that they extend an equal distance from the side frame protion 22 perpendicular to the downwardly depending projection formations 40, 42.

Figure 5:
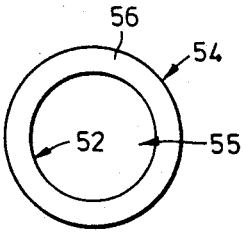
FIG. 5 is an end elevational view of the front or rear portion of the preferred embodiment shown in FIG. 1.
Figure 6:
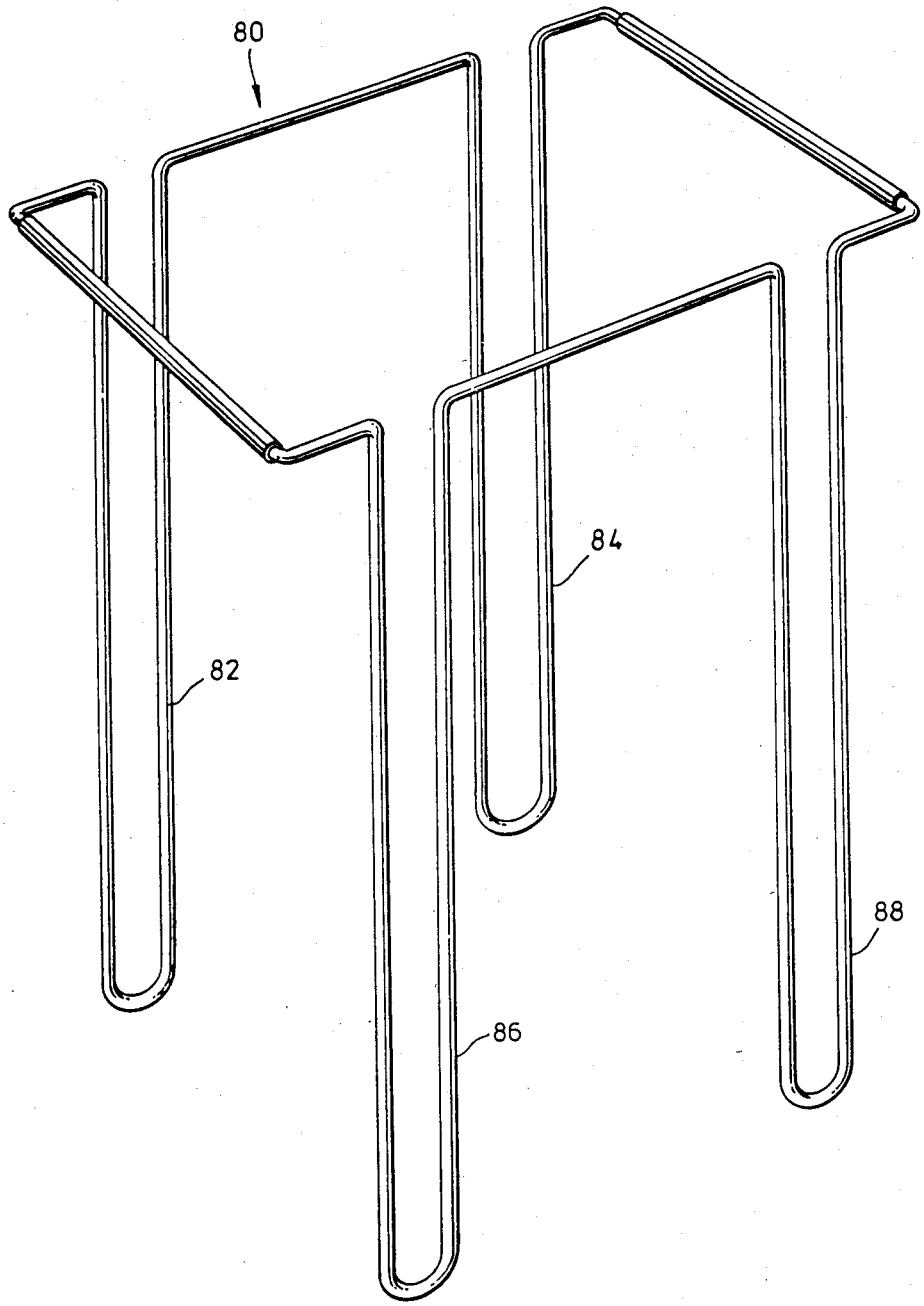
FIG. 6 is a perspective view of a second embodiment of a collapsible support frame made in accordance with the invention taken from a point to the right and upwardly of the front portion thereof.

As best illustrated in FIG. 5 tubes 12, 14 of support frame 10 defining the front and rear frame portions 16, 18 respectively have an axis extending longitudinally about which a symmetrical inner surface 52 is defined by a substantially constant first radius. Outer surface 54 is defined by a substantially constant second radius symmetrical about the longitudinally extending central axis such that the second radius is greater than the first mentioned radius defining a constant wall thickness 56 extending longitudinally symmetrically about the axis. A longitudinally centrally extending cavity 55 is thus defined extending throughout tubes 12, 14.

The inner radius 52 of tubes 12, 14 and the outer radius of metal rods 24, 26 have a matching extent so as to allow ends 44, 46, and 48, 50 of metal rods 24, 26 respectively to be presented within cavity 55 of the respective ends of tubes 12, 14 in an interengaging relation so that the metal rods define with the tubes a support frame 10 within which a receptacle or liner can be disposed.

The receptacle or liner 58 is preferably produced from a heavy duty plastic material in such a manner as described in U.S. Pat. No. 3,227,137.

The receptacle or liner is fabricated from a long tubular section of plastic material folded inwardly at opposite sides for approximately one-third of the total diameter of the tube to present folds on either sides. After the folds have been made the tubular arrangement is compressed and a heat seam is made substantially along the bottom edge thereof.

As the receptacle or liner is separated so as to present front, rear and side panels 62, 64, and 66, 68 respectively, the heat sealed seam is exposed producing triangular configurations 70, 72 which are directed towards the bottom panel 74 of the receptacle or liner to act as reinforcements, all as described in U.S. Pat. No. 3,227,137 and best illustrated in FIG. 2.

Figure 2:
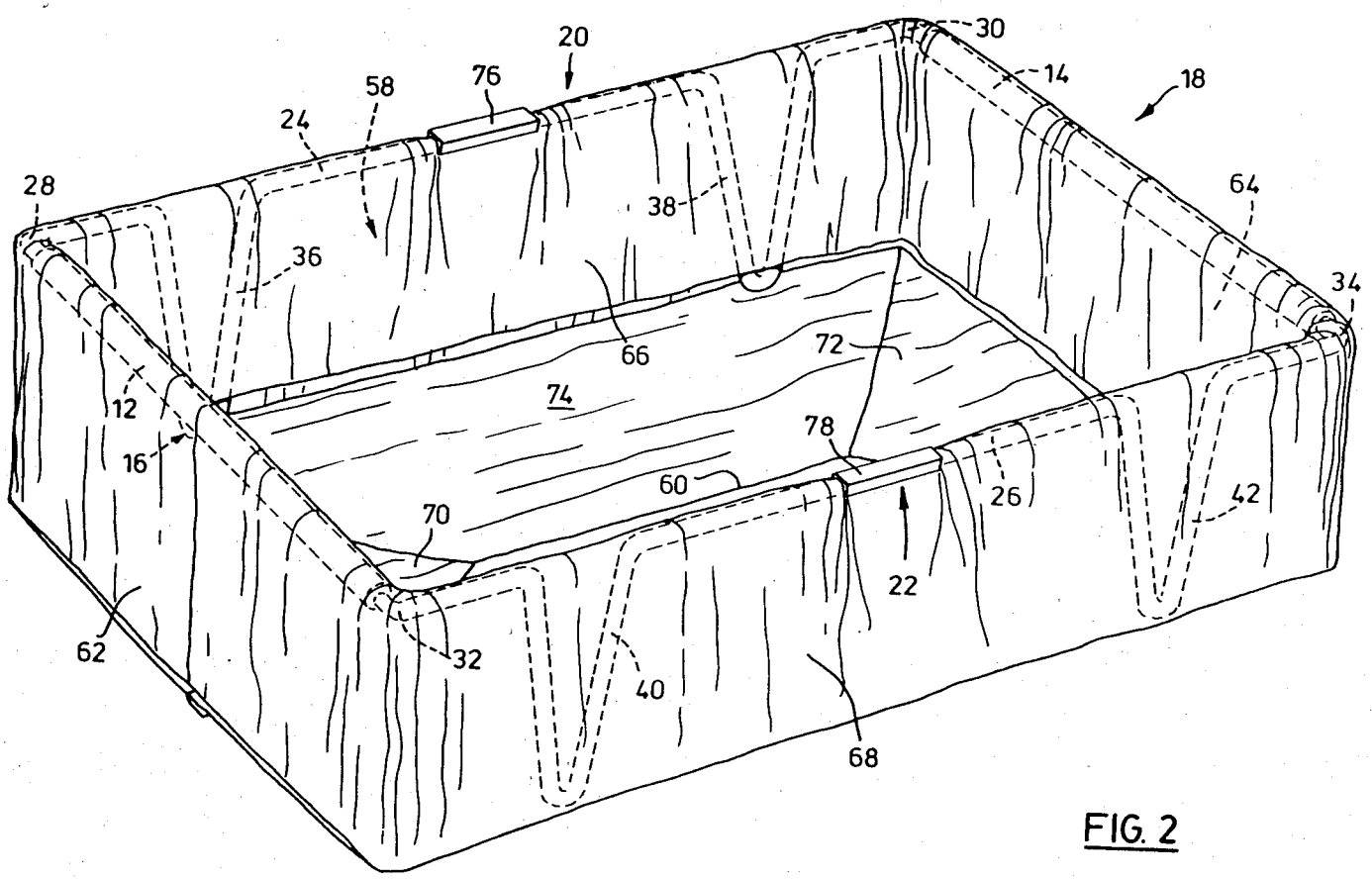
FIG. 2 is a perspective view of the preferred embodiment of a collapsible support frame with receptacle made in accordance with the invention taken from a point to the right and upwardly of the front portion thereof.
Figure 3:
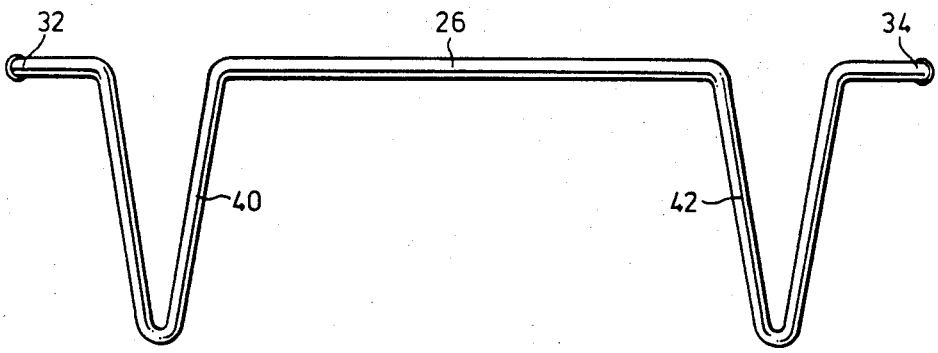
FIG. 3 is a side elevational view taken from the right of the preferred embodiment shown in FIG. 1.
Figure 4:
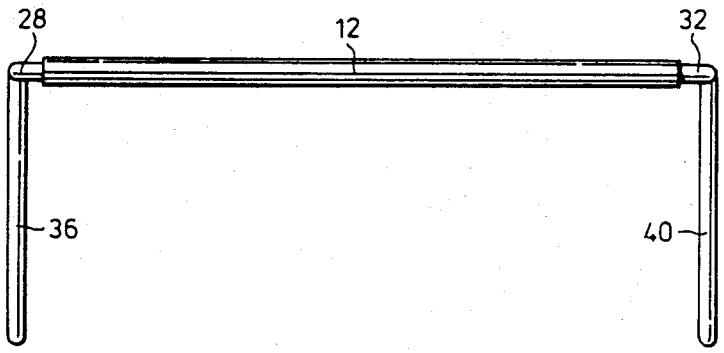
FIG. 4 is a front elevational view of the preferred embodiment shown in FIG. 1.

The front, rear and side panels 62, 64, and 66, 68 respectively of receptacle or liner 58 have an extent in the vertical direction exceeding the extent of the downwardly depending projection formations 36, 38 and 40, 42 of metal rods 24, 26 respectively in the vertical direction and, in the preferred embodiment, illustrated in FIG. 2, extending a distance substantially twice the vertical extent of said projection formations.

By suitably dimensioning the receptacle or liner 58 the front and rear panels 62, 64 and side panels 66, 68 fit snugly within the front and rear frame portions 16, 18 and side frame portions 20, 22 of support frame 10. By having the vertical extent of receptacle or liner 58 being substantially twice the vertical extent of the downwardly projecting formations of metal rods 24, 26 the receptacle or liner can be folded such that the upper perimetral extent of said receptacle or liner extends downwardly so as to be adjacent the supporting surface upon which downwardly depending projection formations 36, 38 and 40, 42 are in contact.

Thus it can be seen that front and rear panels 62, 64 and side panels 66, 68 form a constraining boundary being relatively taut so that when same is folded over the front and rear frame portions 16, 18 and the side frame portions 20, 22, the front, rear and side frame portions are constrained against separation so that the support frame 10 is maintained in a stable erect configuration.

More particularly, it is emphasized that the receptacle or line 58 engages metal rods 24, 26 and tubes 12, 14 when folded thereover such that the ends 44, 46 and 48, 50 of metal rods 24, 26 respectively are firmly held in position within the respective ends of tubes 12, 14 so that the substantially constant inner surface 52 of tubes 12, 14 and the substantially constant outer surface of metal rods 24, 26 are in an interengaging relation constraining same and thus maintaining support frame 10 in an erect stable configuration.

It can be appreciated that when receptacle or liner 58 is filled with a suitable material, such as cat litter for the embodiment illustrated in FIG. 2, the filler material will apply pressure outwardly upon front and rear panels 62, 64 and side panels 66, 68 of receptacle or liner 58. This increases the tautness of the front and rear panels 62, 64 and side panels 66, 68 of receptacle or liner 58 so that a firmer grip is provided on the front and rear frame portions 16, 18 and side frame portions 20, 22 respectively thus further constraining the ends 44, 46 and 48, 50 of metal rods 24, 26 respectively within cavity 55 of tubes 12, 14 respectively.

Clips 76, 78, preferably of a plastic material, are provided so as to engage side panels 66, 68 of receptacle or liner 58 where same are folded over metal rods 24, 26 of side portions 20, 22 side panels 66, 68 are secured to the metal rods 24, 26 thus preventing the receptacle or liner 58 from slipping over the upper surface of the side frame portions 20, 22.

By preventing the liner or receptacle 58 from slipping over the upper surface of metal rods 24, 26 a firmer engaging of the receptacle or liner 58 upon the metal rods 24, 26 of the side frame portions 20, 22 and upon the tubes 12, 14 of the front and rear frame portions 16, 18 can be achieved thus further aiding in constraining the support frame 10 in an erect stable configuration.

When the material or fill within the receptacle or liner 58 is ready to be disposed of the receptacle or liner can be removed from support frame 10 by first disengaging the clips 76, 78 from the receptacle or liner then lifting the receptacle or liner from the support frame. This causes the receptacle or liner 58 to disengage metal rods 24, 26 of side frame portions 20, 22 and tubes 12, 14 of the front and rear frame portions 16, 18. The receptacle or liner can now be emptied or disposed of in a conventional manner. Support frame 10 shall remain in its erect configuration throughout the removal of the used receptacle or liner thus being ready to receive the cleaned receptacle or liner or a fresh receptacle or liner.

If the support frame 10 is to be moved to a new location it can be appreciated that with the liner or receptacle 58 disengaged from the support frame metal rods 24, 26 can disengage tubes 12, 14 allowing the support frame 10 to be reduced to a compact state fascilitating the ease of transportation of same.

More particularly support frame 10 can be reduced to its constituent parts, namely metal rods 24, 26 and tubes 12, 14 which can readily be packaged in a compact manner reducing bulk and facilitating the ease of tranportation of the support frame.

An alternative embodiment for the collapsible support frame is illustrated in FIG. 7 wherein the collapsible support frame 80 has projection formations 82, 84, and 86, 88 having such an extent that the vertical dimension of said surface engaging projection formations is greater than the length or width of the perimetral extent of the collapsible support frame 80.

The invention can thus be seen to be applicable to a wide range of areas requiring a collapsible support frame for a receptacle. It can be seen that in the form depicted in figure 1 the support frame for a receptacle can be used, for example, as a cat litter box. If the invention is to be used wherein a deeper receptacle or liner is required, such as in the disposal of garbage or, for example, fallen leaves, the form of the collapsible support frame depicted in FIG. 7 should be used.

Finally it will be understood that variations or alternatives may be introduced or included to the collapsible support frame described and illustrated by those persons skilled in this field without departing from the spirit or scope of the invention defined by the appended claims.

What I claim is:

1. A collapsible support frame with receptacle wherein said frame is of generally rectilinear configuration including opposed spaced apart front and rear frame portions connected together with opposed spaced apart side frame portions, said side frame portions in the regions of the opposed spaced apart front and rear frame portions respectively presenting downwardly projecting surface engaging formations of like extent, said receptacle including opposed front and rear panels and opposed side panels terminating lowermost in a bottom panel and having a perimetral extent so as to be disposable within said collapsible support frame, said opposed front and rear panels and said opposed side panels of said receptacle having a vertical extent exceeding that of said downwardly projecting surface engaging formations of said collapsible support frame and a perimetral extent such that when said opposed front and rear panels and said opposed side panels are folded over the opposed spaced apart front and rear frame portions and opposed spaced apart side frame portions respectively of said collapsible support frame said front and rear frame portions and said side frame portions are constrained against separation.

2. A collapsible support frame with receptacle wherein said frame is of generally rectilinear configuration including opposed spaced apart front and rear frame portions connected together with opposed spaced apart side frame portions, said side frame portions presenting in the regions of opposed spaced apart front and rear frame portions respectively downwardly projecting surface engaging formations of like extent, said receptacle including opposed front and rear panels and opposed side panels terminating lowermost in a bottom panel and having a perimetral extent so as to be dipsosable within said collapsible support frame, said opposed front and rear panels and said opposed side panels of said receptacle having a vertical extent being substantially greater than said vertical extent of said downwardly projecting surface engaging formations of said collapsible support frame and a perimetral extent such that when said opposed front and rear panels and said opposed side panels are folded over the opposed spaced apart front and rear frame portions and opposed spaced apart side frame portions respectively of said collapsible support frame said front and rear frame portions and said side frame portions are constrained against separation in an interengaging relation maintaining said collapsible support frame in an erect stable configuration.

3. A collapsible support frame with receptacle according to claims 1 or 2 wherein said receptacle is secured to said collapsible support frame by a clamping means when said front and rear panels and said side panels of said receptacle are folded over said opposed spaced apart front and rear frame portions and said opposed spaced apart side frame portions respectively of said collapsible support frame.

4. A collaptsible support frame with receptacle according to claims 1 or 2 wherein said collapsible support frame has a vertical plane of symmetry extending from front to rear.

5. A collapsible support frame with receptacle according to claims 1 or 2 wherein said collapsible support frame has a vertical plane of symmetry extending from side to side.

6. A collapsible support frame with receptacle wherein said frame is of generally rectilinear configuration including opposed spaced apart front and rear frame portions comprised of cylindrical tubes having substantially constant inner and outer surfaces extending throughout the axial extent of same connected together with opposed spaced apart side frame portions comprised of cylindrical rod-like formations having a substantially constant outer surface extending throughout the axial extent of same, said side frame portions presenting in the regions of opposed spaced apart front and rear frame portions respectively downwardly projecting surface engaging formations of like extent, said receptacle including opposed front and rear panels and opposed side panels terminating lowermost in a bottom panel and having a perimetral extent so as to be disposable within said collapsible support frame, said opposed front and rear panels and said opposed side panels of said receptacle having a vertical extent being substantially greater than said vertical extent of said downwardly projecting surface engaging formations of said collapsible support frame and a perimetral extent such that when said opposed front and rear panels and said opposed side panels are folded over the opposed spaced apart front and rear frame portions and opposed spaced apart side frame portions respectively of said collapsible support frame said front and rear frame portions and said side frame portions are constrained in an interengaging relation against separation by said opposed front and rear panels and said opposed side panels of said disposable receptacle maintaining said collapsible support frame in an erect stable configuration.

7. A collapsible support frame with receptacle according to claim 6 wherein said receptacle is secured to said collapsible support frame by a clamping means when said front and rear panels and said side panels of said receptacle are folded over said opposed spaced apart front and rear frame portions and said opposed spaced apart side frame portions respectively of said collapsible support frame.

8. A collapsible support frame with receptacle according to claims 6 or 7 wherein said collapsible support frame has a vertical plane symmetry extending from front to rear.

9. A collapsible support frame with receptacle according to claims 6 or 7 wherein said collapsible support frame has a vertical plane of symmetry extending from side to side.

10. A collapsible support frame with receptacle wherein said frame is of generally rectilinear configuration including opposed spaced apart front and rear frame portions comprised of cylindrical tubes having substantially constant inner and outer surfaces extending throughout the axial extent of same connected together with opposed spaced apart side frame portions comprised of cylindrical rod-like formations having a substantially constant outer surface extending throughout the axial extent of same, said side frame portions presenting in the regions of opposed front and rear frame portions respectively downwardly projecting surface engaging formations of like extent, and said side frame portions having said cylindrical rod-like formations presenting near their respective end regions right angle turns positioning the ends of said cylindrical rod-like formations such that they extend an equal distance from said side frame portions perpendicular to the downwardly projecting surface engaging formations such that when said frame is in an erect stable configuration said ends presented by said right angle turns of said cylindrical rodlike formations of said side frame portions are placed within the ends of said cylindrical tubes of said front and rear frame portions such that said substantially constant inner surface of said cylindrical tubes engages said substantially constant outer surface of said cylindrical rod-like formations, said receptacle including opposed front and rear panels and opposed side panels terminating lowermost in a bottom panel and having a perimetral extent so as to be disposable within said collapsible support frame, said opposed front and rear panels and said opposed side panels of said receptacle having a vertical extent being substantially greater than said vertical extent of said downwardly projecting surface engaging formations of said collapsible support frame and a perimetral extent such that when said opposed front and rear panels and said opposed side panels are folded over the opposed spaced apart front and rear portions and opposed spaced apart side frame portions respectively of said collapsbile support frame said cylindrical tubes of said front and rear frame portions and said cylindrical rod-like formations of said side frame portions are constrained against separation in an interengaging relation by said opposed front and rear panels and said opposed side panels of said disposable receptacle maintaining said collapsible support frame in an erect stable configuration.

11. A collapsible support frame with receptacle according to claim 10 wherein said receptacle is secured to said collapsible support frame by a clamping means when said front and rear panels and said side panels of said receptacle are folded over said opposed spaced apart front and rear frame portions and said opposed spaced apart frame portions respectively of said collapsible support frame.

12. A collapsible support frame with receptacle according to claims 10 or 11 wherein said collapsible support frame has a vertical plane of symmetry from front to rear.

13. A collapsible support frame with receptacle according to claims 10 or 11 wherein said collapsible support frame has a vertical plane of symmetry extending from side to side.

14. A collapsible support frame with receptacle according to claims 10 or 11 wherein said collapsible support frame has a vertical plane of symmetry extending from front to rear and a vertical plane of symmetry extending from side to side.

* * * * *